US011385004B2

(12) United States Patent
Sredl

(10) Patent No.: US 11,385,004 B2
(45) Date of Patent: Jul. 12, 2022

(54) DEVICE FOR SECURING AN AMMUNITION CONTAINER

(71) Applicant: Victor J. Sredl, Paducah, KY (US)

(72) Inventor: Victor J. Sredl, Paducah, KY (US)

( * ) Notice: Subject to any disclaimer, the term of this patent is extended or adjusted under 35 U.S.C. 154(b) by 0 days.

(21) Appl. No.: 17/366,301

(22) Filed: Jul. 2, 2021

(65) Prior Publication Data

US 2022/0003513 A1 Jan. 6, 2022

Related U.S. Application Data

(60) Provisional application No. 63/047,386, filed on Jul. 2, 2020.

(51) Int. Cl.

| | |
|---|---|
| ***B25B 1/02*** | (2006.01) |
| ***F41A 9/83*** | (2006.01) |
| ***F41A 9/84*** | (2006.01) |

(52) U.S. Cl.

CPC ..... *F41A 9/84* (2013.01); *B25B 1/02* (2013.01); *F41A 9/83* (2013.01)

(58) Field of Classification Search

CPC .... F41A 9/82; F41A 9/83; F41A 23/04; F41A 23/05; F41A 23/16; F16M 11/02; B25B 1/02

See application file for complete search history.

(56) References Cited

U.S. PATENT DOCUMENTS

| | | | | | |
|---|---|---|---|---|---|
| 486,124 | A * | 11/1892 | Rager | B25B 1/20 | 269/254 R |
| 4,304,062 | A * | 12/1981 | Pepe | F41A 9/83 | 42/87 |
| 4,923,186 | A * | 5/1990 | Durfee, Jr. | B25B 1/24 | 269/282 |
| 5,419,540 | A * | 5/1995 | Teafatiller | B25B 1/2463 | 269/283 |
| 6,668,479 | B1 * | 12/2003 | Obong | F41A 9/68 | 42/90 |
| 6,672,578 | B1 * | 1/2004 | Martens | B25B 1/2468 | 269/282 |

FOREIGN PATENT DOCUMENTS

| | | | | |
|---|---|---|---|---|
| TW | M249762 U | * | 11/2004 | |
| WO | WO-8801725 A | * | 3/1988 | F41A 9/83 |
| WO | WO 03203308 A1 | * | 3/2003 | F41A 9/83 |

* cited by examiner

*Primary Examiner* — Gabriel J. Klein
(74) *Attorney, Agent, or Firm* — Millen, White, Zelano & Branigan, P.C.; William Nixon

(57) ABSTRACT

A device to secure and hold an ammunition magazine includes a block using a channel, a receiving ramp, and a slider to accommodate a variety of sizes for the magazine. The block can be made of metal or plastic. The block includes a front edge and a back edge. The front edge includes an opening for the receiving ramp. The metal block also includes side edges. A first side edge includes a machine hole to receive a thrust bolt having a knob that turns to move the slider within the channel. The second side edge is removable and borders the receiving ramp. The slider extends into the receiving ramp as moved by the thrust bolt to secure the magazine. The receiving ramp descends at an angle from the front edge to the back edge to accommodate the magazine.

20 Claims, 10 Drawing Sheets

DEVICE FOR SECURING AN AMMUNITION CONTAINER

FIELD OF THE INVENTION

The present invention relates to a device to secure an ammunition container, such as an ammunition magazine. In some embodiments, the device may be used with ammunition clips or to provide firearm maintenance.

DESCRIPTION OF THE RELATED ART

Ammunition magazines traditionally are loaded by hand. One would need to place ammunition into the magazine individually Ammunition loader devices, such as those made by MAGLULA™, (hereinafter known as "ammunition loaders" or "loaders") also may be used to load the ammunition quicker. Different loaders may be used for different magazines, such as ones for pistol magazines and others for various rifle magazines. Loaders transfer the ammunition to the magazine. Further, magazines do not rest on flat surfaces in a secure manner. They need to be held while loading, which is unwieldy and awkward. The user may not be able to apply the pressure needed to load the magazine. Current devices that address these issues tend to only fit one size of magazine.

SUMMARY OF THE INVENTION

The disclosed embodiments provide for an ammunition container holder that includes a metal or plastic block that is machined to accommodate a metal or plastic slider. The slider preferably is in one piece, but may be multiple pieces. The slider is slidably engaged in a channel so that it may move in when driven by a thrust bolt. The thrust bolt engages with the metal block through a threaded machine hole. As the thrust bolt is rotated in a clockwise direction, it drives the slider towards a receiving ramp. When the thrust bolt is rotated in the opposite direction, it retreats away from the slider and releases any clamping pressure exerted by the slider on the ammunition magazine. As disclosed below, the ammunition container may refer to an ammunition magazine for a rifle or pistol, or to an ammunition clip.

The receiving ramp slopes in a downward manner from the front edge of the metal block towards a rear stop at the far end of the ramp. The channel and the ramp have the same descending slope from front to rear and are contiguous surfaces. The descending ramp is configured to slidably receive various ammunition magazines for reloading. The stop at the back of the metal block may be fabricated as an integral part of the block.

At the rear side of the channel and also at the bottom of the stop is a back groove that starts on the bottom of the stop and extends along the back side of the channel. The back groove receives a slider rail of the slider. There also is a front groove which slidably receives a slider rail of the slider. Slider rails engage into the grooves to allow lateral movement of the slider when acted upon by the thrust bolt. Slider rails also prevent the screw force applied by the thrust bolt from twisting or "torqueing" the slider. The slider rails prevent the slider from rising on one end or getting jammed in the channel.

In some embodiments, an ammunition magazine slides down the receiving ramp until it engages the stop. Once the magazine engages the stop, the thrust bolt is rotateably driven against the slider to move it against the magazine to clamp the magazine into the device. The ammunition magazine is now secure in the device and ready for loading or unloading.

The receiving ramp is configured to descend at such an angle so as to substantially fit the slope of the base of the ammunition magazine and render it in a vertical upright position for loading and unloading ammunition. The bases of ammunition magazines are angled. If one is placed on a table or flat surface, the ammunition angle will tilt forward. The angle of the slope for the receiving ramp approximates the angle necessary to make the ammunition angle so that the ammunition slides backward into the magazine. A magazine loader may be mounted on top of the ammunition magazine. In this manner, a user can easily load or unload ammunition to or from the magazine and do so in a much faster manner than if doing the same operation by holding the magazine manually.

A device for securing an ammunition container is disclosed. The device includes a block. The block includes a back edge. The block also includes a front edge opposite the back edge. The front edge includes an opening for a receiving ramp. The block also includes a first side edge between the back edge and the front edge having a machine hole. The block also includes a second side edge between the back edge and the front edge, and opposite the first side edge. The second side edge includes a removable piece that borders the receiving ramp. The receiving ramp descends at an angle from the front edge to the back edge. The device also includes a channel formed between the front edge and the back edge. The device also includes a slider to fit within the channel. The slider extends into an area above the receiving ramp. The device also includes thrust bolt configured within the machine hole to move the slider within the channel.

An alternate embodiment of a device for securing an ammunition container is disclosed. The device includes a block. The block includes a back edge. The block also includes a front edge opposite the back edge. The block also includes a fixed side edge between the back edge and the front edge. The fixed side edge has a machine hole therethrough. The block also includes a removable side edge between the back edge and the front edge. The removable side edge includes a removable piece. The block also includes a receiving ramp positioned next to the removable side edge. The receiving ramp slopes at an angle from the front edge to the back edge. The device also includes a channel formed between the front edge and the back edge and adjacent the receiving ramp. The device also includes a slider to fit and slidably move within the channel using a thrust bolt extending through the machine hole through the fixed side edge. The slider is movable into an area above the receiving ramp. The device also includes a shim to fit into the area above the receiving ramp. The shim is narrower than a width of the receiving ramp and having a sloped surface that substantially matches the slope of the receiving ramp. The shim is removable from the block.

A system to load ammunition is disclosed. The system includes an ammunition container to hold the ammunition. The ammunition container includes a base. The system also includes a block. The block includes a back edge. The block also includes a front edge opposite the back edge. The front edge includes an opening. The block also includes a fixed side edge between the back edge and the front edge. The fixed side edge includes a machine hole. The block also includes a removable side edge between the back edge and the front edge, and opposite the fixed side edge. The removable side edge includes a removable piece. The block also includes a receiving ramp adjacent the removable side edge and aligned with the opening of the front edge. The receiving ramp descends at an angle from the front edge to the back edge such that the base of the ammunition container rests on the receiving ramp. The system also includes a channel formed between the front edge and the back edge. The system also includes a slider to slidably move within the channel to clamp the ammunition container on the receiving ramp. The system also includes a thrust bolt configured within the machine hole to move the slider within the channel.

BRIEF DESCRIPTION OF THE DRAWINGS

Various other features and attendant advantages of the present invention will be more fully appreciated when considered in conjunction with the accompanying drawings.

DETAILED DESCRIPTION OF THE PREFERRED EMBODIMENTS

Reference will now be made in detail to specific embodiments of the present invention. Examples of these embodiments are illustrated in the accompanying drawings. Numerous specific details are set forth in order to provide a thorough understanding of the present invention. While the embodiments will be described in conjunction with the drawings, it will be understood that the following description is not intended to limit the present invention to any one embodiment. On the contrary, the following description is intended to cover alternatives, modifications, and equivalents as may be included within the spirit and scope of the appended claims.

Figure 1:
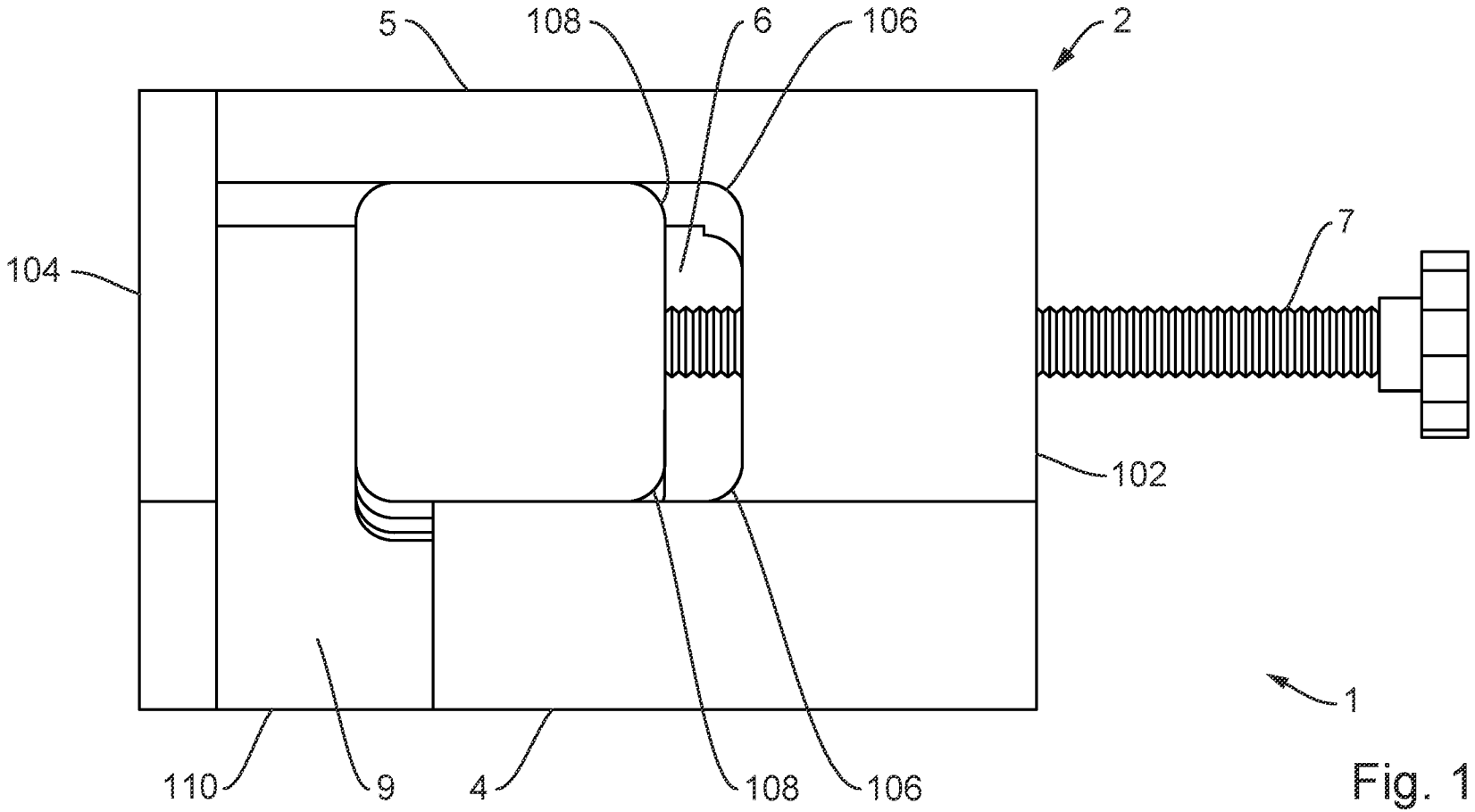
FIG. 1 illustrates a top plan view of the device according to the disclosed embodiments.

FIG. 1 depicts a top plan view of device 1 according to the disclosed embodiments. Device 1 may be known as an ammunition container holder that fits a variety of magazine sizes, as disclosed below. The disclosed embodiments may refer to the ammunition container as an ammunition magazine, but also may apply to clips. Device 1 includes block 2, which provides stability for loading operations. Block 2 may be comprised of metal, such as aluminum. Alternatively, block 2 may be comprised of plastic or a polymer material. Hereinafter, block 2 may be referred to as metal block 2 even though it is understood that the block also may be comprised of plastic or a combination of metal and plastic components. In some embodiments, block 2 may have a width of about 4.0 inches and a length of about 5.8 inches along with a height of about 1.3 inches.

Device 1 also includes slider 3 that moves within channel 6. Channel 6 is formed within metal block 2 between front edge 4 and back edge 5. Metal block 2 also includes side edges 102 and 104. Side edge 102, also known as the first side edge, includes curved portions 106 that help form channel 106. Curved portions 106 of side edge 102 accommodate curved portions 108 of slider 3. The curved portions of side edge 102 and slider 3 allow the slide to move within channel 3 is a smooth manner, as opposed to sharp corners in metal block 2. Thus, curved portions 106 and 108 avoid the sharp edges associated with sharp corners.

Slider 3 also is removable from device 1. Removable side edge 104, disclosed below, may be removed to remove slider 3 from channel 6. With a removable slider 3, one can access channel 6 and the grooves, disclosed in greater below, that it slides in for cleaning and removing any accumulated debris. Further, slider 3 along with removable side edge 104 provide square surfaces for greater contact with the secured magazine. Slider 3 may include other shapes and possibly could be comprised of a plurality of pieces.

Opposite side edge 102 is removable side edge 104, also positioned between front edge 4 and back edge 5. Side edge 104 also may be known as the second side edge. Side edge 104 is removable from metal block 2, as disclosed in greater detail below. When side edge 104 is removed, slider 3 may be removed from channel 6. Removable side edge 104 also removes the need to form a sharp corner, such as one with approximately a 90° angle, as the removable side edge is constructed separate from back edge 5 and front edge 4. Sharp corners may require special tools. Magazines tend to have straight and perpendicular lines so removable side edge 104 allows to be implemented in device 1 to have the magazine corner be perpendicular to both the back and side of the device. Removable side edge 104 allows device 1 to have straight lines.

Figure 2:
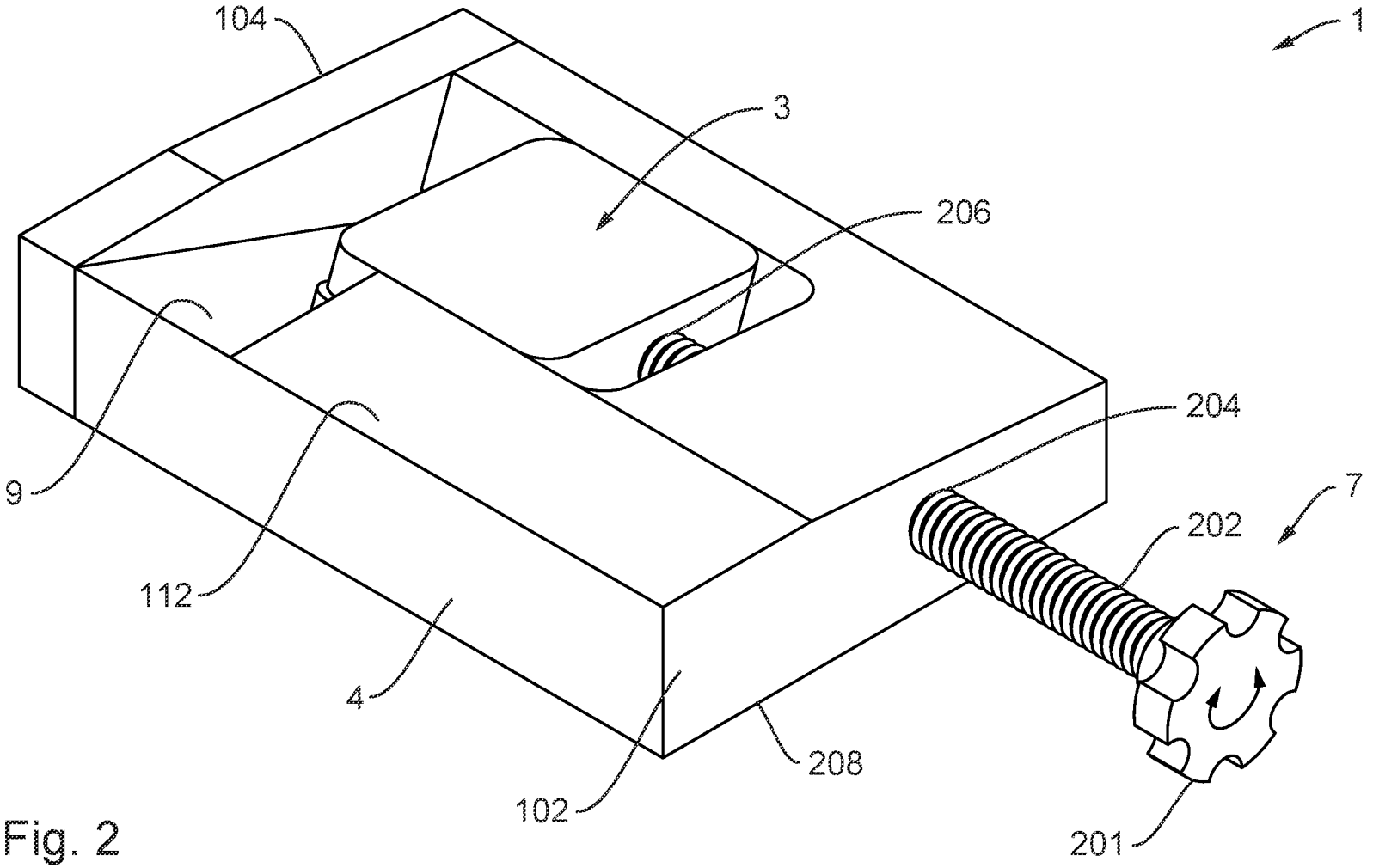
FIG. 2 illustrates a right isometric view of the device according to the disclosed embodiments.

Referring to FIG. 2, side edge 102 includes threaded machine hole 204. Machine hole 204 receives thrust bolt 7. Thrust bolt 7 includes knob 201 and threaded portion 202 that rotates within machine hole 204. Thrust bolt 7 drives slider 3 within channel 6 by turning knob 201. Receiving portion 206 within slider 3 engages an end of threaded portion 202 opposite knob 201 of thrust bolt 7. As thrust bolt 7 is rotated in a clockwise direction when facing the top surface of knob 201, threaded portion 202 drives slider 3 towards side edge 104 and away from side edge 102. When thrust bolt 7 is rotated in the opposite, or counter-clockwise, direction, threaded portion 202 retreats away from slider 3 away and towards side edge 102. Slider 3 may be moved back towards side edge 102 in channel 6 manually, or by hand. In this manner, slider 3 and thrust bolt 7 may clamp an ammunition magazine within device 1. Knob 201 should be positioned at a height from a bottom 208 of metal block 2 to allow fingers to turn the knob without hitting a surface upon which device 1 is resting.

Front edge 4 includes an opening for receiving ramp 9 within metal block 2. Receiving ramp 9 slidably receives various ammunition magazines onto device 1 for reloading. Receiving ramp 9 descends at an angle from front edge 4 to back edge 5. Preferably, this angle is between 15° and 25°. Receiving ramp 9 also borders the interior of side edge 104. As disclosed below, receiving ramp 9 and channel 6 have the same descending slope from front to back, and may be contiguous surfaces. An opening 110 may be formed between a top surface 112 of front edge 4 and side edge 104 to accommodate receiving ramp 9.

Use of receiving ramp 9 allows device 1 to secure the magazine in a manner that allows use of the ammunition loader in a convenient, efficient, and safe manner. It also allows users having difficulty grasping the magazine to load ammunition. The slope of receiving ramp 9, or the angle of descent, also allows for the magazine to be tilted back a little. Most magazine are angled in that the bottom of the magazine results in the magazine being positioned to tilt forward on a flat surface. This aspect makes loading ammunition difficult. Receiving ramp 9 approximates the necessary angle that positions the magazine to tilt backwards so that the ammunition slides into the magazine backwards, which makes it easier to load bullets. Further, the slope of receiving ramp 9 allows the user to keep his/her arm in a straight line and avoids bending the wrist awkwardly during loading operations.

Figure 3:
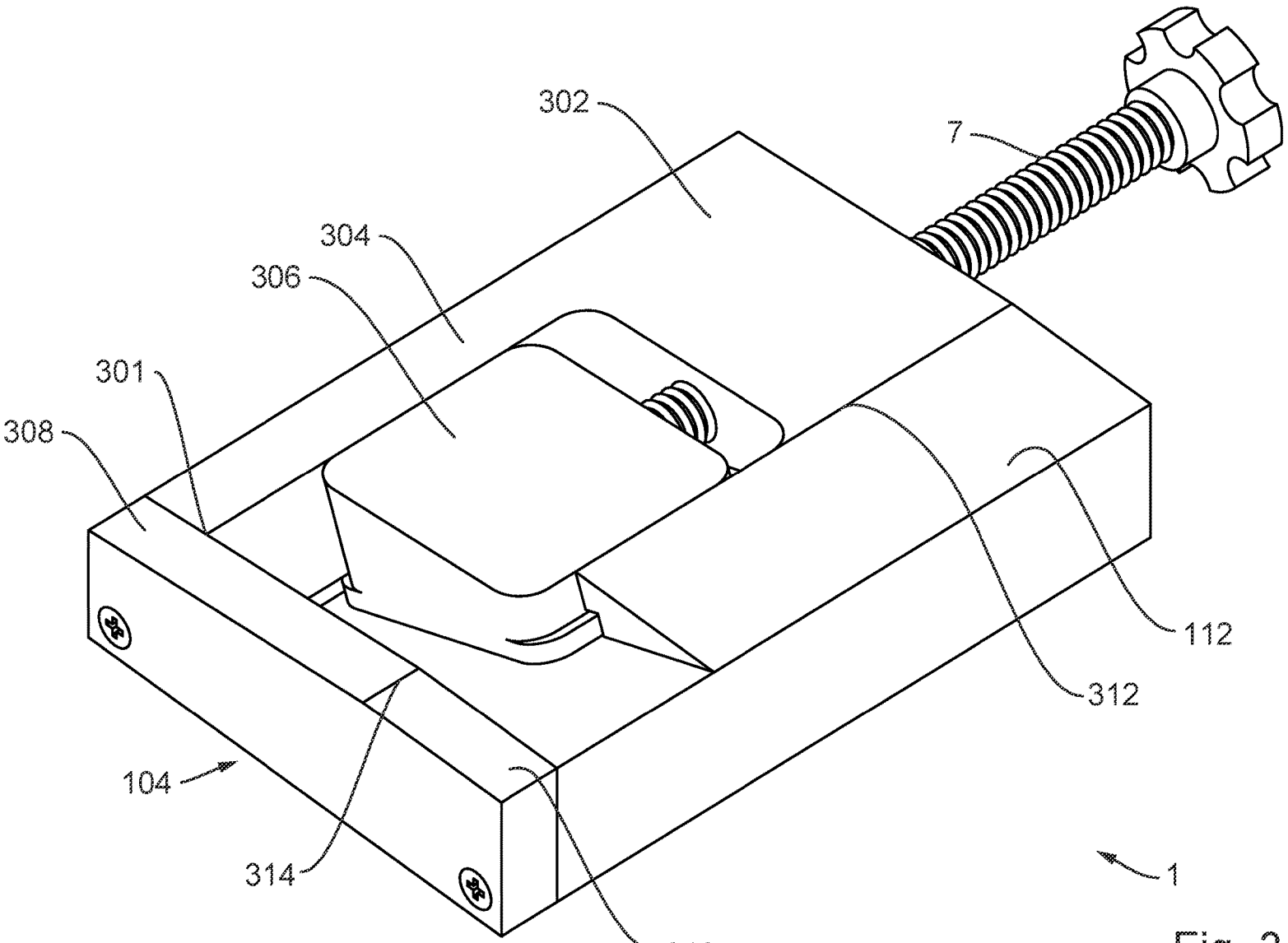
FIG. 3 illustrates a left isometric view of the device according to the disclosed embodiments.

FIG. 3 depicts another perspective view of device 1 according to the disclosed embodiments. Components of front edge 4, back edge 5, side edge 102, and side edge 104 are disclosed in greater detail. As shown, side edge 104 is removable from metal block 2. This feature allows the formation of corner 301 where side edge 104 meets back edge 5, without the need for special machining. This feature also allows a more accurate fit for a magazine received in device 1, specifically within receiving ramp 9.

Front edge 4 includes top surface 112. Top surface 112 may be substantially parallel with bottom 208 of block 2, or with the surface of a table, floor, and the like in which the device is placed. Top surface 112 allows a user to determine the location of front edge 4 and to securely grasp device 1.

Side edge 102 also includes a top surface 302 that descends at an angle from border 312 with top surface 112 of front edge 4. The angle of descent may be slight, such as between 2-5° toward the back of metal block 2. Top surface 302 of side edge 102 joins with top surface 304 of back edge 5. The descending top surfaces of side edge 102 and back edge 5 also allows a user to locate a position for device 1. The user may understand that the descending top surfaces also border channel 6 and slider 3. It also may be stated that top surfaces 302 and 304 have a slope with regards to a surface upon which device 1 is resting.

Side edge 104 includes top surface 310 that is aligned with top surface 112 of front edge 4. Side edge 104 also includes sloped surface 308 that is aligned with top surfaces 302 and 304. In other words, sloped surface 308 also descends from its border 314 with top surface 310 at the same angle as top surfaces 302 and 304 towards back edge 5. These features keep side edge 104, which is removable, consistent with the features disclosed above with regard to the other components of metal block 2.

Slider 3 is shown having a top surface 306 as well. Top surface 306 is machined to match the slope or angle of descent of top surfaces 302 and 304. Again, this feature keeps the look and feel of top surface 306, or slider 3 as a whole, consistent with the rest of device 1.

Figure 4:
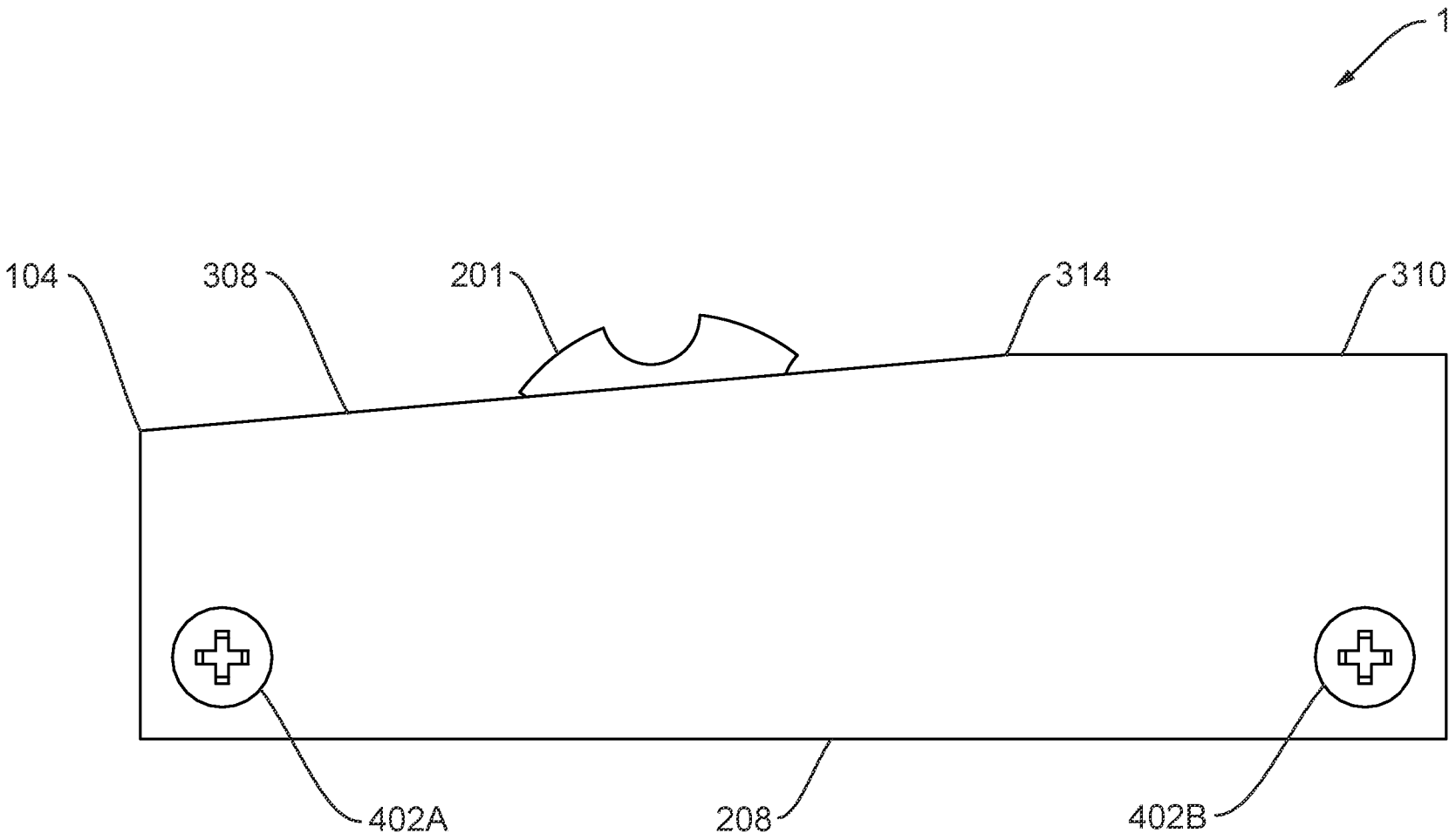
FIG. 4 illustrates a left elevation view of the device according to the disclosed embodiments.

FIG. 4 depicts a left side elevation view of device 1 highlighting removable side edge 104 of device 1 according to the disclosed embodiments. This view provides a side profile of device 1 to show the consistencies of the various top and sloped surfaces disclosed above. Side edge 104 includes top surface 310, which is substantially parallel to bottom 208 of device 1. Top surface 310 also is substantially level with top surface 112 of front edge 4. Sloped edge 308, on the other hand, begins to slope downward from border 314 to back edge 4. Sloped edge 308 is substantially level with top surfaces 302 and 304, disclosed above.

Side edge 104 also may include screws 402A and 402B that secure the removable side edge into metal block 2. Screw 402A may be positioned towards the back of side edge 104 while screw 402B may be positioned towards the front of side edge 104. Screws 402A and 402B may fit any type of screwdriver or other tool to secure side edge 104 to metal block 2. A Philips head is shown for the screws, but they may also include a head to receive a flat head, torx, alien, double square, triple square, or the like utilizing a screwdriver or bit.

Figure 5:
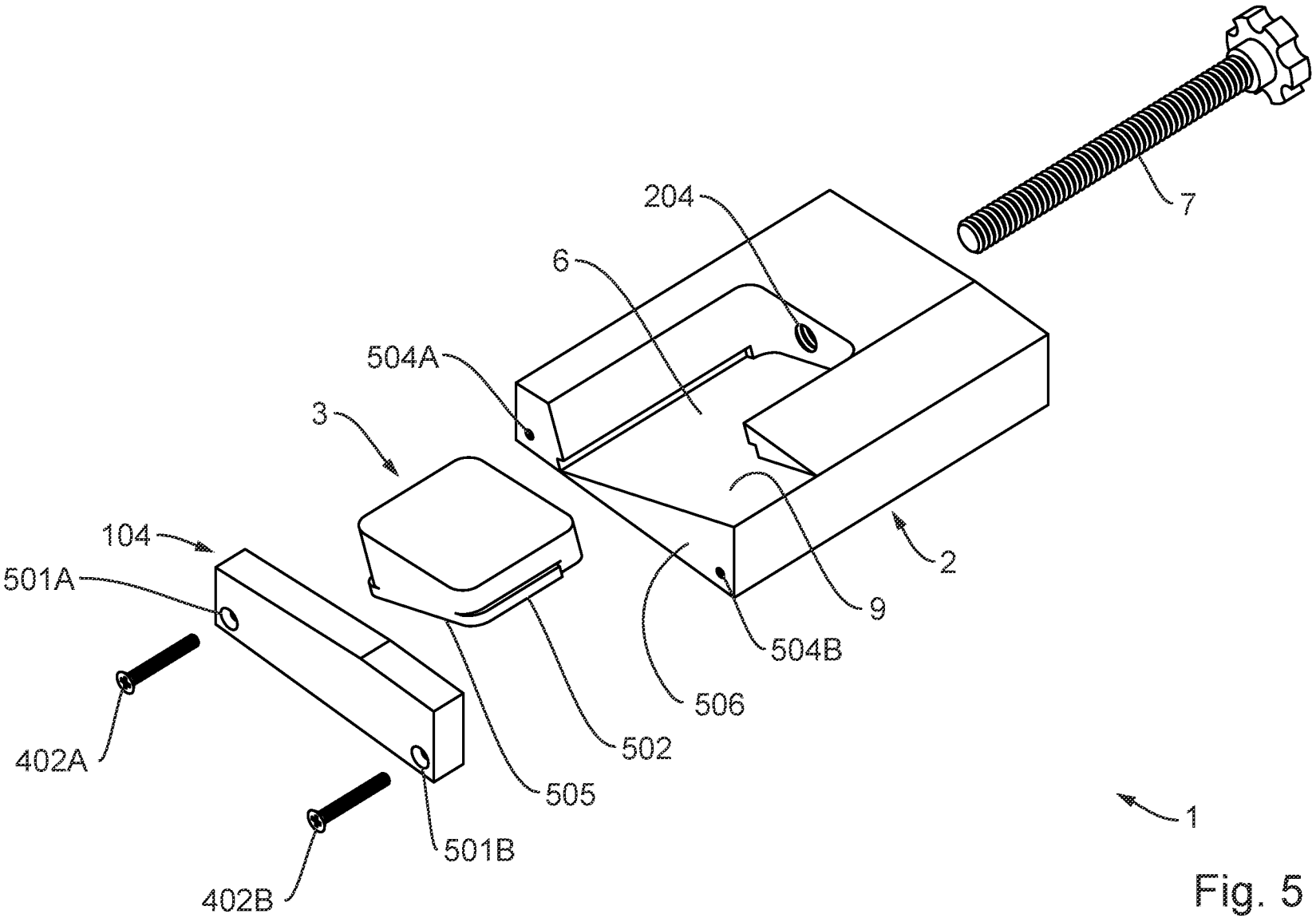
FIG. 5 illustrates an exploded isometric view of the device according to the disclosed embodiments.

FIG. 5 depicts an exploded isometric view of device 1 according to the disclosed embodiments. Side edge 104 is removed from metal block 2. Screws 402A and 402B are shown positioned apart from side edge 104 and metal block 2. Screw holes 501A and 501B also are shown in side edge 104. Screw hole 501A receives screw 402A to attach side edge 104 to base 506 of metal block 2 using screw hole 504A located therein. Screw hole 501B receives screw 402B to attach side edge 104 to base 506 using screw hole 504B located therein. Using these features, side edge 104 may be removed as desired.

As noted above, the removable feature of side edge 104 means that a sharp corner does not have to be machined in device 1. Side edge 104 may be formed separately from the rest of metal block 2 and attached thereto to form corner 301. It also allows for maintenance of device 1. Other embodiments may allow for multiple side edges 104 to be attached, with different configurations or shapes to accommodate a variety of ammunition magazines. The user also may clean channel 6 easier with side edge 104 removed.

Removal of side edge 104 allows slider 3 also to be removed from device 1. Slider 3 may need to be removed for cleaning device 1 or other maintenance activities. Further, different sliders may be used in device 1, such as a slider with a tab or groove within top surface 306 for the user to grasp or use to position the slider. Slider 3 also includes slider rails 502 positioned at a bottom 505 of the slider. The features of slider rails 502 are disclosed in greater detail below. Bottom 505 fits onto the bottom surface of channel 6. As shown, slider rails 502 may not extend the whole length of slider 3. This feature allows for removal of slider 3 from metal block 2 in an easier manner and to fit into channel 6, which includes curved portions 106.

Machine hole 204 shown extends through side edge 102 to channel 6. Thus, thrust bolt 7 fits through machine hole 204 to engage slider 3. Thrust bolt 7 also may be removed from device 1 for cleaning and maintenance.

Figure 6:
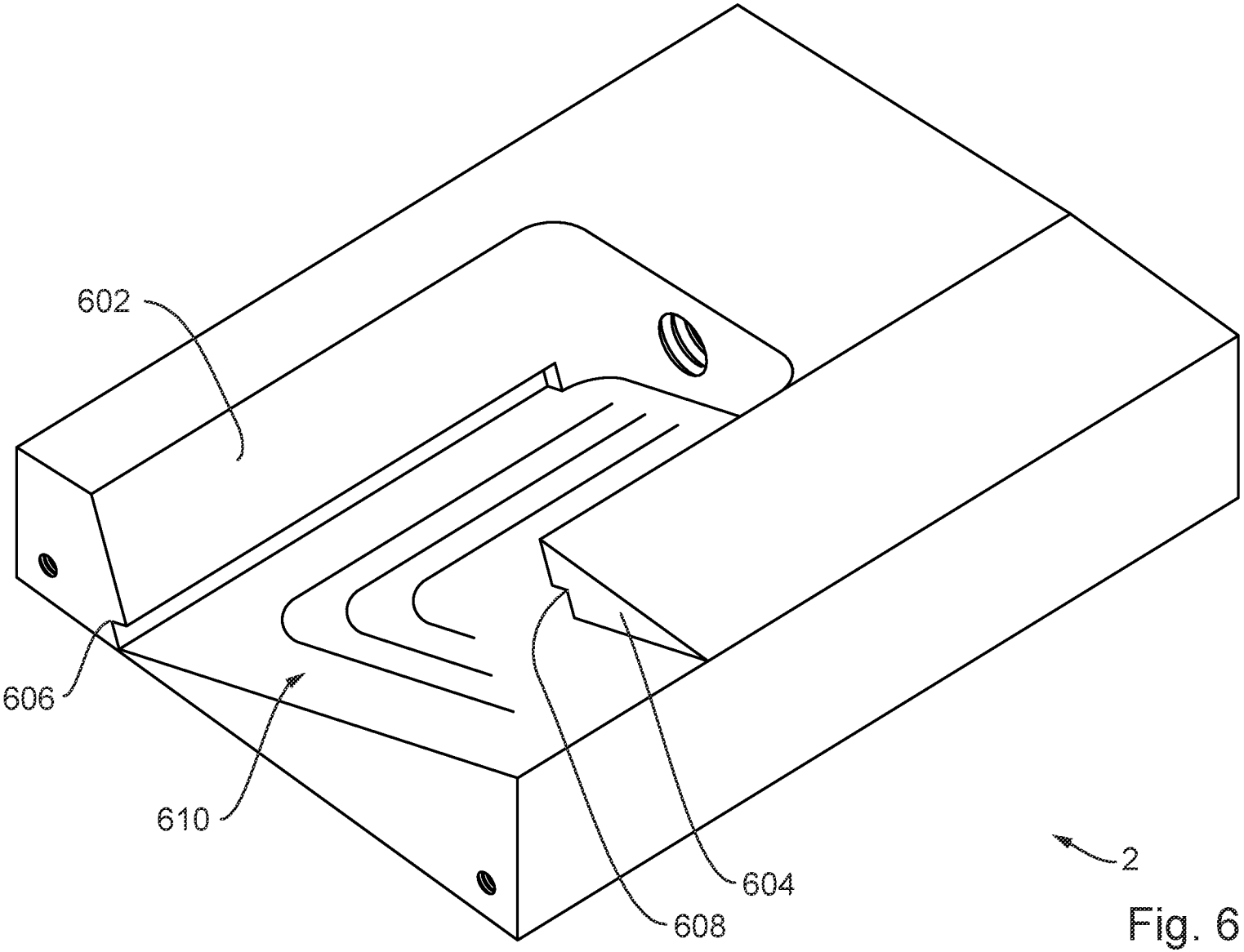
FIG. 6 illustrates a left isometric view of the block within the device according to the disclosed embodiments.

FIG. 6 depicts another left isometric view of metal block 2 within device 1 with removable side edge 104 and slider 3 removed according to the disclosed embodiments. This figure provides a better view of channel 6. Metal block 2 includes stop 602. Stop 602 is a surface on which an ammunition magazine will rest when secured by device 1. Stop 602 also slopes outward at an angle from back edge 5. This slope allows magazines having curved surfaces to be accommodated within receiving ramp 9. A rear surface of slider 3 also may rest against stop 602 when it is within channel 6.

Side surface 604 of front edge 4 also is shown. Side surface 604 helps to form opening 110 for receiving ramp 9.

Grooves 606 and 608 are shown. Grooves 606 and 608 receive slider rails 502 of slider 3 to keep the slider within channel 6. This feature allows lateral movement of slider 3 when acted upon by thrust bolt 7. Back groove 606 is formed underneath stop 602 and extends in channel 6 and receiving ramp 9. Front groove 608 is formed in front edge 4 to receive the upper slider rail 502. Slider rails 502 also prevent the twisting or "torqueing" of slider 3 when acted upon by thrust bolt 7.

Channel 6 and receiving ramp 9 may include a pattern 610. Pattern 610 may be formed by slight ridges on the surfaces of channel 6 and receiving ramp 9. These ridges keep slider 3 from directly contacting the surfaces of metal block 2 and to allow it to be more engaged when in use. The bottom of slider 3 is not completely against the metal surfaces forming channel 6 and receiving ramp 9. In other embodiments, pattern 610 may be tooling marks.

Figure 7:
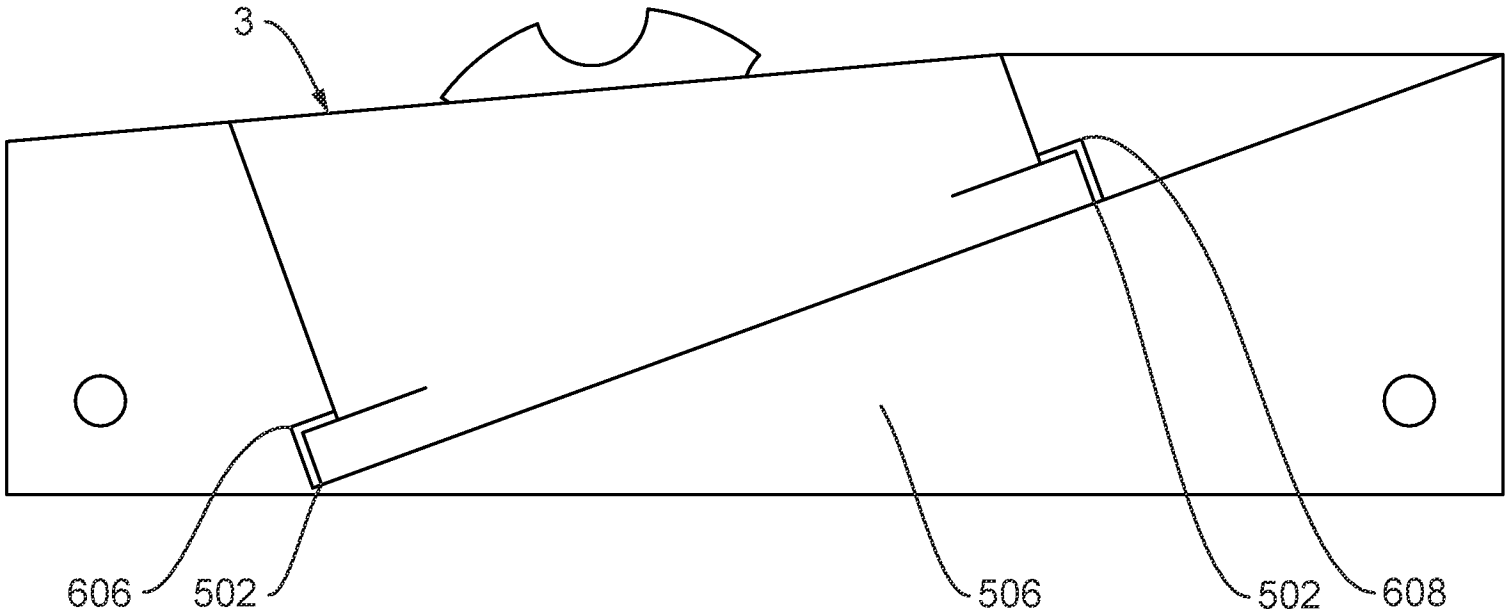
FIG. 7 illustrates a left side elevation view of the device with the removable side edge removed according to the disclosed embodiments.

FIG. 7 depicts a left side elevation view of device 1 with removable side edge 104 removed according to the disclosed embodiments. Slider 3 is shown in use. Slider rails 502 engage back groove 606 and front groove 608. Slider 3 rests on base 506 and moves within channel 6. These features allow slider 3 to provide a uniform force across the magazine when it is secured by device 1. The user turns knob 201 of thrust bolt 7 to move slider 3 within grooves 606 and 608. As also shown, the profile of slider 3 matches that of metal block 2.

Figure 8:
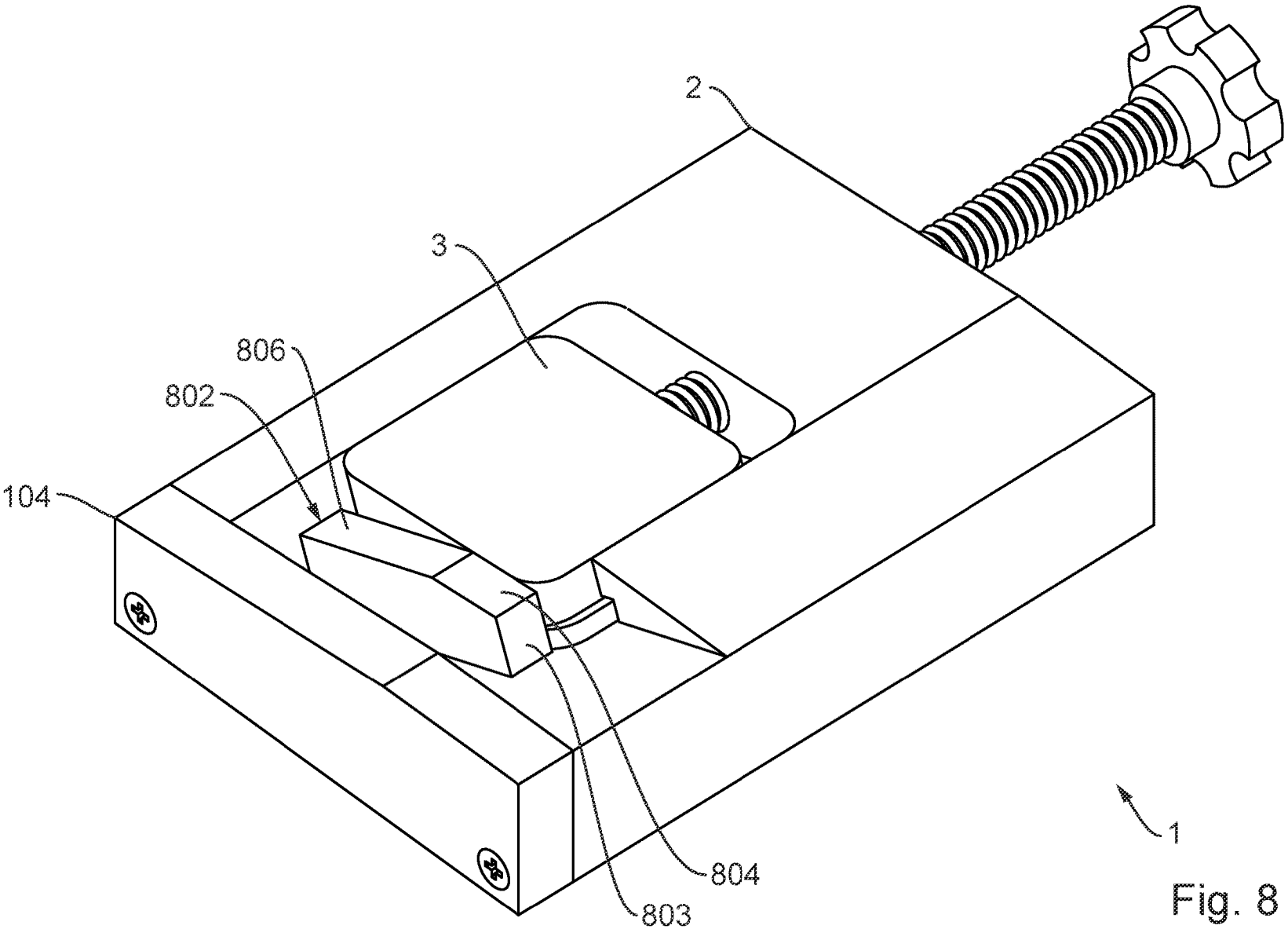
FIG. 8 illustrates a left isometric view of the device using a shim according to the disclosed embodiments.

FIG. 8 depicts a perspective view of device 1 using a shim 802 according to the disclosed embodiments. Shim 802 may be used to help with using a loader with "short" single stack magazines. Shim 802 preferably is narrower than the magazine and raises the magazine so that a loader can still slide the length of the magazine. For example, a loader may be 4.25 inches tall but being used with a magazine being 4 inches tall. Stop 602 may be 1 inch in height. Use of such a loader with the magazine with device 1 without shim 802 would be troublesome. The loader will not have enough travel on the magazine if the user does not implement shim 802.

Referring to FIG. 8, shim 802 fits within channel 6 or receiving ramp 9. Shim 802 includes front surface 803 that faces upwards toward opening 110 for receiving ramp 9. Shim 802 may be slightly longer than slider 3 in order to not get lodged between front edge 4 and back edge 5 in channel 6. Shim 802 also includes top surface 804 that is substantially flush with top surface 306 of slider 3. Top surface 804 touches front surface 803. Shim 802 also includes sloped surface 806 that slopes downward from top surface 803 toward stop 602. Sloped surface 806 may slope at an angle consistent with receiving ramp 9 so that it acts like the surface of receiving ramp 9, but elevated therewithin.

Figure 9:
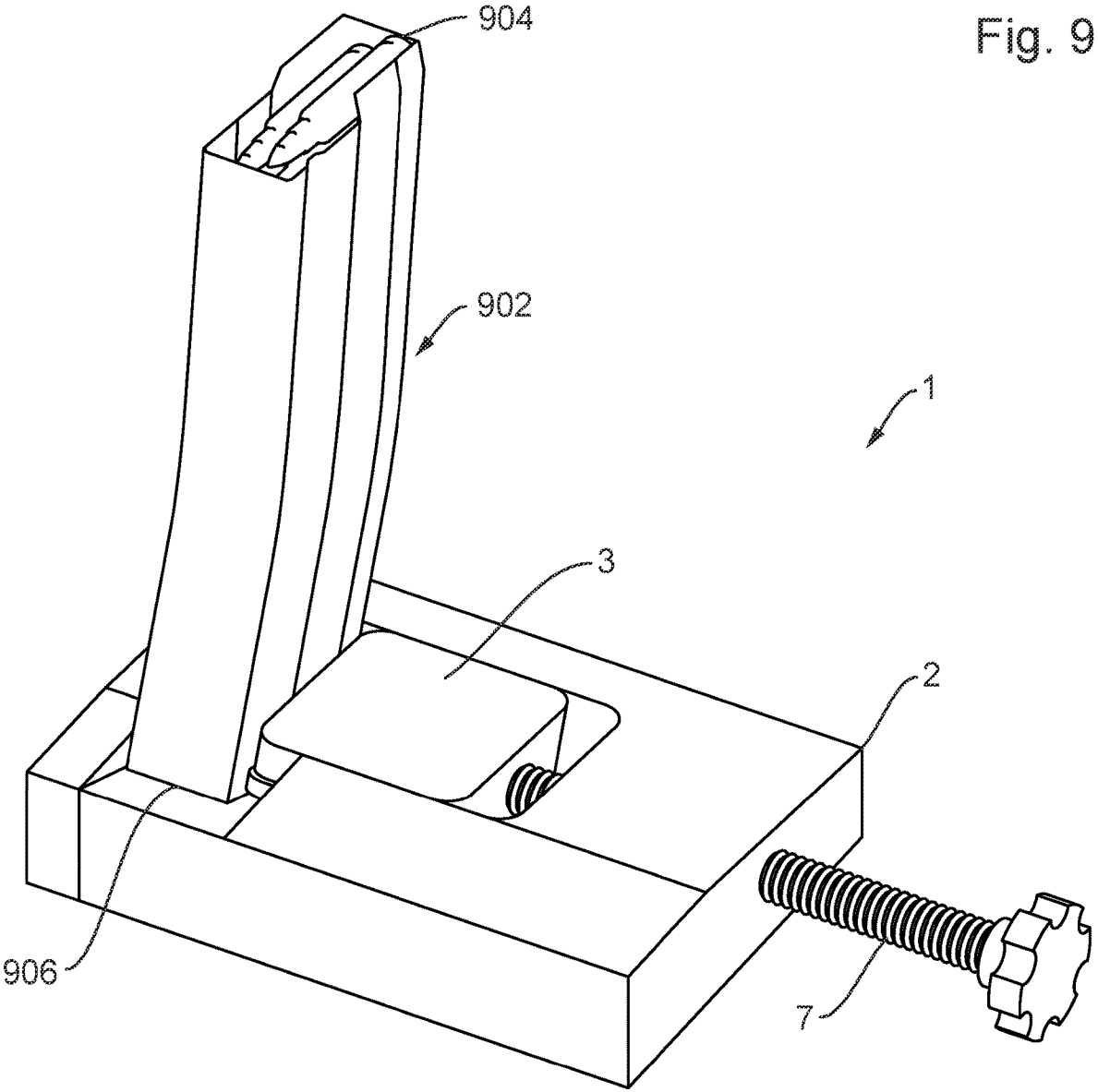
FIG. 9 illustrates a right isometric view of the device securing an ammunition magazine according to the disclosed embodiments.

FIG. 9 depicts a right isometric view of device 1 securing an ammunition magazine 902 according to the disclosed embodiments. Magazine 902 may be considered a rifle magazine used with device 1. Magazine 902 is mounted by sliding base 906 onto receiving ramp 9 to rest the magazine against stop 602. Slider 3 clamps magazine 902 in place by rotating thrust bolt 7 until the magazine is firmly locked in place in order to load or unload ammunition 904. As shown, the slope of receiving ramp is able to accommodate base 906 of magazine 902 in order to provide a relatively upright position, which is convenient for loading and unloading ammunition 904. The vertical, or upright, position is easier to perform these actions then upside down loaders and holding magazine 902 by hand.

In order to use device 1 and ammunition magazine 902, the user would place the ammunition loader on top of the magazine as it is secured. The ammunition loader would then be moved to transfer ammunition 904 from the loader into magazine 902. The user usually holds the loader by hand. Conventional systems would require the user to also hold magazine 902 or orient it downwards or another uncomfortable position to use the loader. These convention systems do not allow magazine 902 to be oriented in the upright position. Further, metal block 2 provides stability during use of the loader with magazine 902. Base 906 preferably does not move around while magazine 902 is being loaded.

Metal block 2 also includes components to adjust device 1 to secure different types of magazines. Magazine 902 is shown as being narrower than the width of receiving ramp 9. Another magazine may include a wider base 906 or one with a different slope/curve. Slider 3 may be adjusted using thrust bolt 7 to widen the receiving portion of device 1. Slider rails 502 provide further stability. As slider 3 is moved by hand using thrust bolt 7, a user should realize when enough force is applied to prevent possible damage to the magazine.

The disclosed embodiments also provide the feature of removable side edge 104. Should magazine 902 get stuck within device 1, such as thrust bolt 7 not being able to turn to move slider 3, then side edge 104 may be removed to release magazine 902. Thus, magazine 902 is not damaged and can be removed easily, especially if ammunition 904 is loaded therein.

Figure 10:
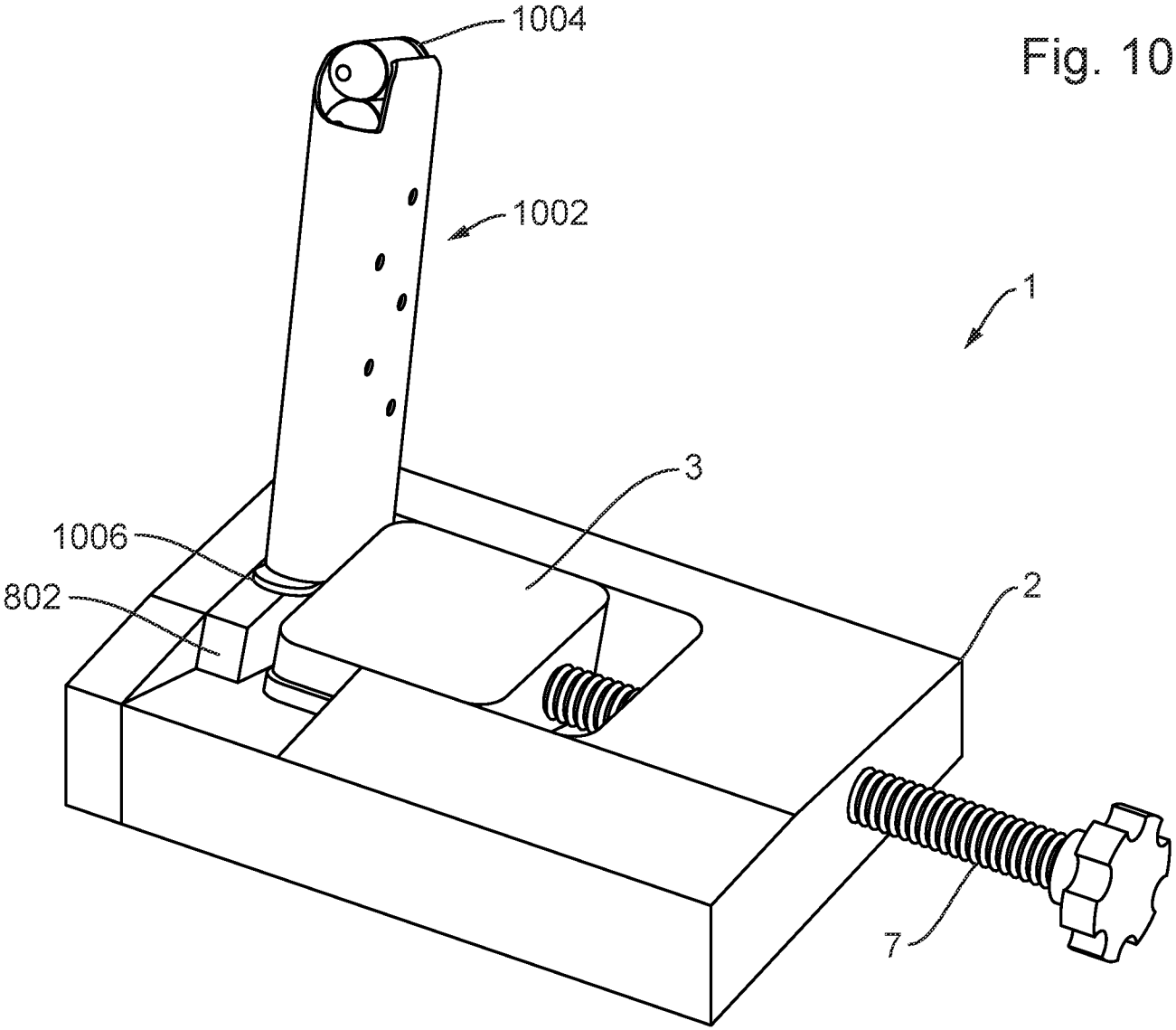
FIG. 10 illustrates a right isometric view of the device securing an ammunition magazine using the shim according to the disclosed embodiments.

FIG. 10 depicts a perspective view of device 1 securing an ammunition magazine 1002 using shim 802 according to the disclosed embodiments. Magazine 1002 may be considered a pistol magazine used with device 1. As disclosed above, shim 802 may be used when a magazine height would cause problems using the ammunition loader Ammunition magazine 1002 may be smaller and thinner than magazine 902. Securing base 1006 of magazine 1002 to receiving ramp 9 may cause problems during loading of ammunition 1004 as the loader would butt against device 1. Metal block 2 could cause damage to the loader as well.

Thus, shim 802 is used to raise base 1006 of magazine 1002 within device 1 to avoid possible butting the loader against metal block 2. Slider 3 still secures magazine 1002 in place. Preferably, shim 802 is narrower than base 1006. As shown in FIG. 10, base 1006 rests against sloped surface 806 of shim 802. When not in use, shim 802 may be removed from device 1 to allow securement of magazines having the size to be used as normal in device 1.

Alternate embodiments include using device 1 for firearm maintenance. A magazine, such as magazine 902, may be secured as disclosed above. The firearm also may be stabilized for maintenance in an upright position and without the firearm being laid on a table or other surface that may not be clean or optimal for such maintenance. Alternate embodiments also may include the use of an ammunition clip Ammunition may be loaded into the clip while it is secured in device 1. Clips are functionally distinct from magazines but both items may be inserted into device 1 for servicing.

It should be noted in the disclosed embodiments, means to fixedly attach device 1 to a working surface such as a work bench, table top, or tail gate may be included to directly bolt the device to the surface, which may be horizontal, inclined, or vertical. Further embodiments may utilize hook and loop attachment means between device 1 and the surface. A suction base also may be used that works on any smooth surface including glass. Alternatively, a c-clamping base that attaches to the edge of a table, work bench, or other surface having a well-formed edge. Such fixed mounting will increase the stability and rigidity of the disclosed embodiments for loading and unloading ammunition.

It will be apparent to those skilled in the art that various modifications to the disclosed may be made without departing from the spirit or scope of the invention. Thus, it is intended that the present invention covers the modifications and variations disclosed above provided that these changes come within the scope of the claims and their equivalents.

The invention claimed is:

1. A device for securing an ammunition container comprising:

a block including a back edge, a front edge opposite the back edge, wherein the front edge includes an opening having a receiving ramp therein, a first side edge between the back edge and the front edge having a machine hole, and a second side edge between the back edge and the front edge, and opposite the first side edge, wherein the second side edge includes a removable piece that borders the receiving ramp, wherein the receiving ramp descends at an angle from the front edge to the back edge;

a channel formed between the front edge and the back edge;

a slider to fit entirely within the channel, wherein the slider extends into an area above the receiving ramp and includes an end surface configured to clamp the ammunition container on the receiving ramp; and a thrust bolt configured within the machine hole to move the slider within the channel.

2. The device of claim 1, wherein the receiving ramp descends within the block at the angle.

3. The device of claim 2, wherein the angle is between 15 to 25 degrees.

4. The device of claim 2, wherein a bottom surface of the slider is formed at an angle relative to a top of the block substantially equal to the angle for the receiving ramp.

5. The device of claim 1, wherein the back edge includes a stop at one end of the receiving ramp.

6. The device of claim 1, wherein the slider includes slider rails.

7. The device of claim 6, wherein the channel includes grooves to receive the slider rails of the slider.

8. The device of claim 1, wherein the block is comprised of metal or plastic.

9. A device for securing an ammunition container, the device comprising:

a block including a back edge, a front edge opposite the back edge, a fixed side edge between the back edge and the front edge, the fixed side edge having a machine hole therethrough, a removable side edge between the back edge and the front edge, wherein the removable side edge includes a removable piece, and a receiving ramp positioned next to the removable side edge, wherein the receiving ramp slopes at an angle from the front edge to the back edge;

a channel formed between the front edge and the back edge and adjacent the receiving ramp;

a slider to fit and slidably move entirely within the channel using a thrust bolt extending through the machine hole through the fixed side edge, wherein the slider is movable into an area above the receiving ramp and includes an end surface configured to clamp the ammunition container on the receiving ramp; and a shim to fit into the area above the receiving ramp, the shim narrower than a width of the receiving ramp and having a sloped surface that substantially matches the slope of the receiving ramp, wherein the shim is removable from the block.

10. The device of claim 9, wherein the block is comprised of metal or plastic.

11. The device of claim 9, wherein the angle is between 15 to 25 degrees.

12. The device of claim 9, wherein the slider includes slider rails configured on opposite sides of the slider.

13. The device of claim 12, wherein the channel includes grooves to receive the slider rails of the slider.

14. The device of claim 9, wherein the slider is comprised of metal.

15. The device of claim 9, wherein the removable side edge is secured to the block using at least two screws.

16. The device of claim 9, wherein the back edge includes a stop facing into the channel and the receiving ramp.

17. A system to load ammunition, the system comprising:

an ammunition container to hold the ammunition, wherein the ammunition container includes a base;

a block including a back edge, a front edge opposite the back edge, wherein the front edge includes an opening, a fixed side edge between the back edge and the front edge, wherein the fixed side edge includes a machine hole, a removable side edge between the back edge and the front edge, and opposite the fixed side edge, wherein the removable side edge includes a removable piece, and a receiving ramp adjacent the removable side edge and aligned with the opening of the front edge, wherein the receiving ramp descends at an angle from the front edge to the back edge such that the base of the ammunition container rests on the receiving ramp;

a channel formed between the front edge and the back edge;

a slider to fit and slidably move entirely within the channel and including an end surface configured to clamp the ammunition container on the receiving ramp; and a thrust bolt configured within the machine hole to move the slider within the channel.

18. The system of claim 17, wherein the block is comprised of metal or plastic.

19. The system of claim 17, wherein the ammunition container is a rifle magazine or a pistol magazine.

20. The system of claim 17, further comprising a shim placed between the receiving ramp and the base of the ammunition container.

* * * * *